United States Patent [19]

Avery

[11] 4,262,801

[45] Apr. 21, 1981

[54] CONTAINER FOR FRAGILE ARTICLES

[76] Inventor: John R. Avery, 523 Detroit St., Denver, Colo. 80206

[21] Appl. No.: 780,714

[22] Filed: Mar. 24, 1977

[51] Int. Cl.[3] ..... B65D 30/08; B65D 85/38

[52] U.S. Cl. ..... 206/522; 150/7; 150/52 F

[58] Field of Search ..... 206/522; 150/1, 7, 52 F; 229/56

[56] References Cited

U.S. PATENT DOCUMENTS

| | | | |
|---|---|---|---|
| 2,681,142 | 6/1954 | Cohen | 206/522 |
| 2,977,973 | 4/1961 | Chakine | 206/522 X |
| 3,556,186 | 1/1971 | Besthorne | 150/1 X |
| 3,587,794 | 6/1971 | Mattel | 206/522 X |
| 4,155,453 | 5/1979 | Ono | 206/522 |

FOREIGN PATENT DOCUMENTS

| | | | |
|---|---|---|---|
| 816532 | 7/1969 | Canada | 206/522 |
| 1443340 | 5/1966 | France | 206/522 |
| 1603215 | 4/1971 | France | 206/522 |
| 2288687 | 5/1976 | France | 206/522 |
| 284761 | 8/1952 | Switzerland | 150/7 |
| 848248 | 9/1960 | United Kingdom | 206/522 |
| 1394877 | 5/1975 | United Kingdom | 206/522 |

*Primary Examiner*—Stephen Marcus

*Attorney, Agent, or Firm*—Sheridan, Ross, Fields & McIntosh

[57] ABSTRACT

The total container comprises inner and outer container bodies, each closed at the bottom and sides and open at the top. The side margins of the inner container body are sealingly connected to the side margins of the outer container body, and the bottom margin of the container body is sealingly connected to at least one wall of the outer container body. The bottom of the compartment within the inner container body is a substantial distance above the bottom of the outer container body. The upper margins of the inner container body are sealingly connected to upper portions of the walls of the outer container body, so that the inner container body serves as a partition between first and second inflation chambers having valved air flow ports. The upper end of the outer container body may be wrapped up into a spiral formation to seal the compartment and the container as a whole. An article is placed in the compartment, the open end is sealed, and the chambers are inflated, forcing excess air out of the compartment through an outlet port. The stored article is suspended within the compartment, gripped by its walls and spaced from all of the outer parts of the container, which protects it from mechanical shock and moisture. The sealing of the container may be improved by including a resiliently yieldable filler strip within the spiral formation to increase its bulk and hence the sealing pressure.

12 Claims, 11 Drawing Figures

CONTAINER FOR FRAGILE ARTICLES

BACKGROUND OF THE INVENTION

This invention lies in the field of protective enclosures for fragile or delicate articles and relates to enclosures which protect such articles from mechanical shock and from moisture. More particularly it relates to means forming an air cushion around the article which absorbs shocks, excludes moisture, and serves as a safety float in case the article is dropped in water.

Many devices have been made and used in the past using inflatable compartments for flotation, insulation, protection against shock or heat loss, and the like. They have included pneumatic jackets to surround heated or cooled liquids for heat insulation, inflatable packaging units having recesses to receive stored articles, inflatable liners for boxes, and other arrangements. Examples of such devices are found in U.S. Pat. Nos. 2,729,259 to Abrams, No. 3,366,231 to Trakas, and No. 3,587,794 to Mattel. All of these schemes work reasonably well for their intended purposes but have limited utility and do not have the capability of holding articles of varying sizes and shapes to protect them against injury. Some are designed to hold only articles of a specific size and shape, others merely provide a space surrounded to some extent by inflated cushioning material in which articles are free to fall from one position to another and be damaged, while others provide cushioning material only in certain locations with no protection in other locations.

SUMMARY OF THE INVENTION

The device of the present invention overcomes the difficulties and disadvantages mentioned above and provides a construction which is simple and easy to use, is durable, takes up very little space when not in use, and grips a stored article firmly within a protective cushion of air surrounding the article on all sides. It minimizes temperature changes and serves as a float in the event that the device and stored article are dropped in water.

Generally stated, in its presently preferred form, the container includes an outer container body of flexible material having forward and rear walls which comprise the outer walls of the total container. The walls are closed at the side margins and at the bottom and are open at the top. An inner container body is provided which is also provided with forward and rear walls whose side margins and bottom are closed and whose upper margins are open to provide a storage compartment within it for reception of articles to be protected. The side margins of the inner container body are sealingly connected to the side margins of the outer container body and the upper margins of the inner container body are sealingly connected to the upper portions of the forward and rear walls of the outer container body. The line of attachment may be at the upper end of the outer container body but preferably is some distance down.

The bottom margin of the inner container body is sealingly connected to at least one of the outer walls of the total container. It is desirable that the bottom of the storage compartment be some distance above the bottom of the outer container body so that a stored article will be protected from shock if the container is set down abruptly in its upright position. To achieve this result, in the presently preferred form the bottom margin of the inner container body is connected to one outer wall of the container at a substantial distance above the bottom of the container. As an alternative, the compartment portion may be sealed off a substantial distance above the bottom of the inner container body to define a vertically extensive margin which is then sealingly attached at its bottom edge to the bottom margin of the container.

With the construction just described, the two container bodies cooperate to define a first inflation chamber between the inner container body and a first wall of the outer container body and a second inflation chamber between the inner container body and the second wall of the outer container body, with the inner container body serving as a partition between the two chambers.

A valved air flow port is provided in each wall of the outer container body for independent inflation of the chambers. Fastener means are provided at the upper portions of the walls of the outer container to hold it closed and maintain a uniform shape when the chambers are expanded and prevent a stored article from being expelled accidentally. As the chambers expand, they compress the inner container body and force most of the air out of its through the open end and cause its walls to conform to and grip a stored article.

To provide only flotation and shock protection, any suitable closure may be used for the open end of the container, such as a zipper or grommets and catches. However, since it is intended primarily for total protection of fragile or delicate articles such as cameras, electronic equipment, and the like it is also necessary to prevent entry of moisture, dirt, or other foreign matter. For this purpose the upper portions of the walls of the container are formed to engage each other in facewise sealing relation and adapted to be wrapped up into a spiral formation about an axis extending laterally of the container body to press the walls in sealing relation.

Fastener means are provided in the form of a first portion extending laterally across and secured to one exterior face of the upper portion of the container and a second portion extending laterally across and secured to the other exterior face of the upper portion of the container. Their lines of attachment are well below the top of the container so as to be below the portion which forms the spiral configuration. At least one of the portions is in the form of a vertically extensive elongate lateral strip secured only along its lower marginal edge to the container so that its upper portion will overlie the spiral formation. Cooperating connector means on the two portions serve to lock them together and maintain the spiral formation in tightly wrapped condition. Since the top of the container is sealed before inflation, a valved air flow port passes through the walls of both containers to the compartment to release trapped air in response to expansion of the inflation chambers.

BRIEF DESCRIPTION OF THE DRAWING

Various other advantages and features of novelty will become apparent as the description proceeds in conjunction with the accompanying drawings, in which.

DESCRIPTION OF PREFERRED EMBODIMENTS

The general arrangement of a construction which incorporates various features of the invention is illustrated in FIGS. 1 to 5, in which the total container 10 includes an outer container body 12 and an inner container body 14, both formed of flexible material such as 20 mil vinyl sheet. Although the container may have various planforms for special purposes, it is most practical for it to be flat when deflated and generally rectangular in planform.

Figure 7:
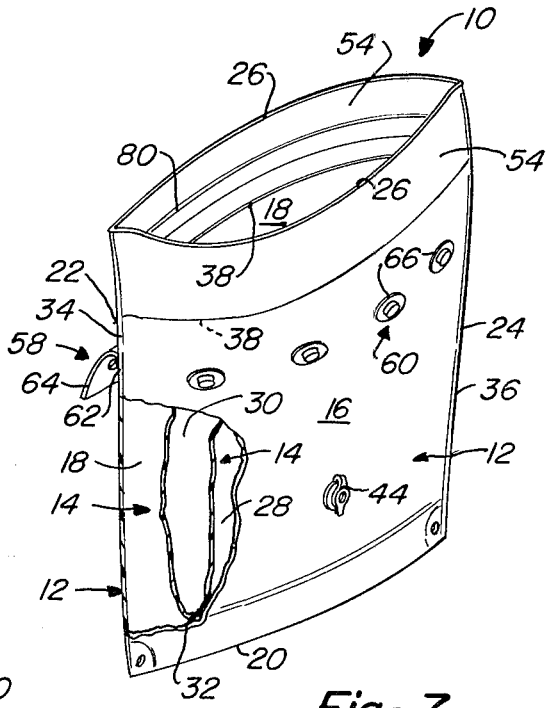
FIG. 7 is a perspective view of the open container with a portion broken away to show the relation of the container bodies.

The outer body 12 has first and second, forward and rear, walls 16 and 18 which comprise the outer walls of the total container. The walls are closed at the bottom 20 and at the side margins 22 and 24 and open at the upper margins 26. The inner body 14 is similar but of less height, and has first and second, forward and rear, walls 28 and 30 which are closed at the bottom 32 and at the side margins 34 and 36 and open at the upper margins 38. The side margins 34 and 36 of body 14 are sealingly connected to side margins 22 and 24, and upper margins 38 are sealingly connected to the upper portions of body 12 as seen in FIG. 7, the lines of attachment being well below the upper margins 26 of body 12. The sealed connections may be made by electronic welding or any other suitable type of permanent bonding. The bottom 32 of body 14 is also sealingly connected to wall 16.

It will be apparent that since walls 28 and 30 and bottom 32 of body 14 are sealingly connected to body 12 all around the perimeter of the body 14 the two bodies cooperate to define a first inflation chamber 40 between body 14 and wall 16 and a second inflation chamber 42 between body 14 and wall 18. Thus, body 14 serves as a partition to prevent flow of air between the two chambers. It will also be apparent in FIG. 4 that chamber 42 extends across the bottom and some distance up along wall 16 to define a cushion below body 14. Inflation ports 44 having check valves 46 and plug caps 48 extend through each of walls 16 and 18 and are bonded in place to provide for supplying air to the inflation chambers. The chambers may be readily and rapidly filled by mouth to the form shown in FIG. 4.

Figure 1:
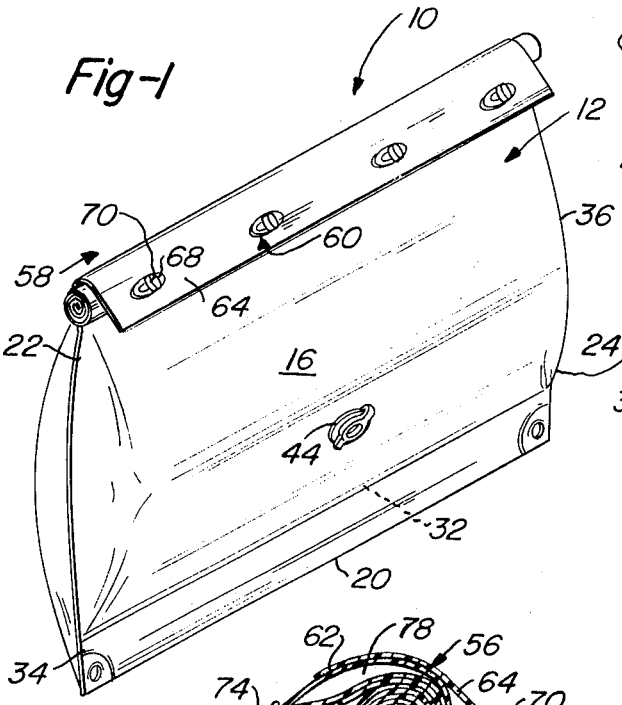
FIG. 1 is a perspective view of the inflated container.
Figure 2:
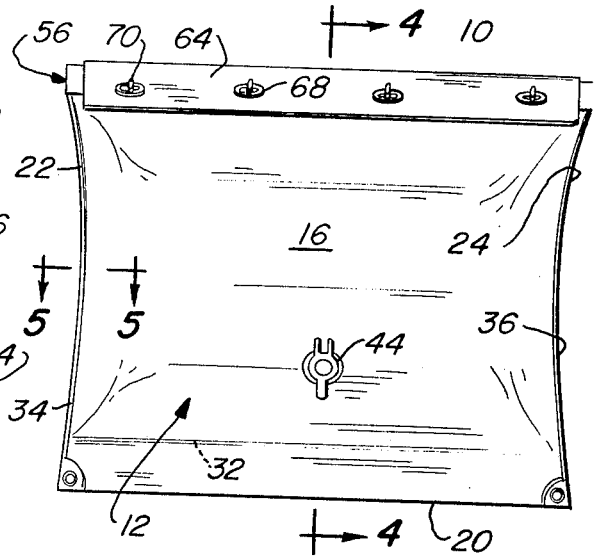
FIG. 2 is a front elevational view of the container of FIG. 1.
Figure 3:
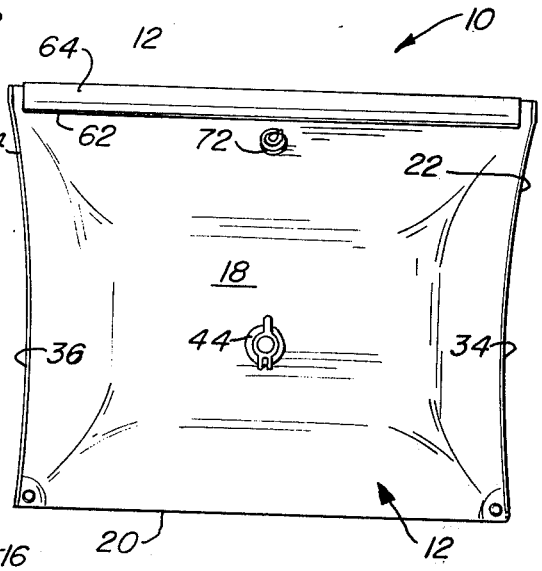
FIG. 3 is a rear elevational view of the container of FIG. 1.
Figure 4:
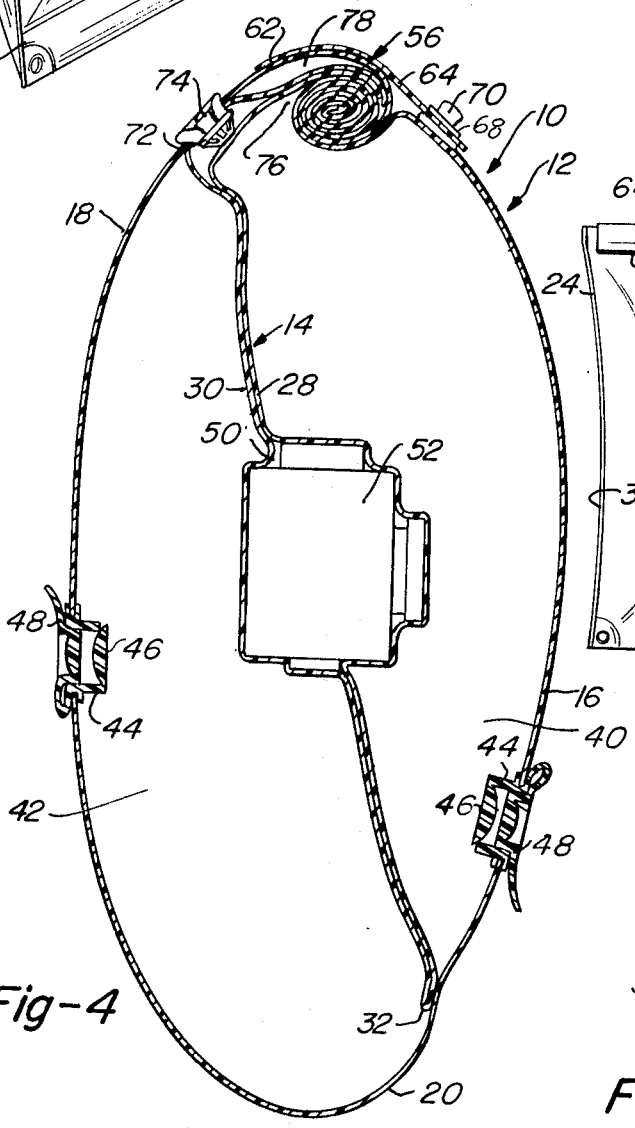
FIG. 4 is a sectional view taken on line 4—4 of FIG. 2.
Figure 5:
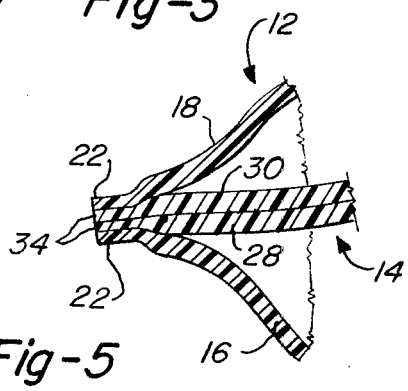
FIG. 5 is a sectional view taken on line 5—5 of FIG. 2.

As the chambers are inflated, they force the major portion of the air out of the storage compartment 50 within the container body 14 and cause it to assume the general shape shown in FIG. 4 with the major area of walls 28 and 30 in facewise contact with each other and with a central portion conforming to and gripping a stored article 52, such as a camera. It is apparent that the stored article is completely suspended in a cushion of air so that it is protected against shock, and the chambers furnish adequate flotation in case the container falls into a body of water.

If it is desired to provide only shock protection and possibly flotation against an accidental fall into water, any suitable closure means may be used for the open end of the container, such as a zipper or grommets and turn-button catches, which will maintain the basic shape of the container and guard against the stored article being accidentally expelled. Such a closure would allow outflow of air from the storage compartment as chambers 40 and 42 are expanded.

However, the container in its most useful form is intended to provide total protection for delicate or fragile articles such as cameras, electronic equipment, and the like by preventing entry into the storage compartment of moisture, dirt, or other foreign matter. It is particularly useful for carrying cameras in kayaks, canoes, and boats, where the articles would constantly be exposed to water for long periods of time. For this purpose the upper portions 54 of the walls of the container are formed to engage each other in facewise sealing relation and are adapted to be wrapped up into a spiral formation 56 about an axis extending laterally of the container body to press the walls tightly in sealing relation as indicated in FIG. 4.

Fastener means are provided in the form of a first portion 58 and a second portion 60. The first portion comprises a vertically extensive elongate lateral strip which extends laterally across wall 18 and is secured only along its lower marginal edge 62 to the wall so that its upper portion 64 may overlie the spiral formation. The second portion comprises a series of fastener members 66 extending laterally across and secured to wall 16. Members 66 may be secured independently and directly to wall 16 or they may be secured to a mounting strip which in turn is secured to the wall. Their lines of attachment are well below the top of the container so as to be below the portion which forms the spiral formation 56. Grommets 68 are mounted near the free edge of portion 64, and fastener member 66 are provided with turn-button catches 70 to lock the two fastener portions together.

To make use of the container in the form just described it is laid flat on a horizontal support. The mouth is opened and the article to be stored is inserted and located generally centrally as indicated in FIG. 4. The upper portion 54 is then wrapped up tightly to form the spiral formation 56, and portion 64 of the fastener means is laid over the spiral formation, fastener members 66 are engaged in grommets 68, and catches 70 are turned to lock the portions together and maintain the spiral formation in tightly wrapped condition to provide an air tight seal for compartment 50. Chambers 40 and 42 are then inflated to compress the inner container body 14 and grip the article 52. Since the compartment 50 is sealed off before inflation, means must be provided to release trapped air from the compartment. An air flow port 72 provided with a push-in plug valve 74 passes through wall 18 and 30 into the storage compartment in the inner container body 14 and is left in the open position until chambers 40 and 42 are fully inflated and all excess air has left the compartment. Valve 74 is then closed and the compartment is completely sealed against the entry of dirt and moisture.

A further feature of the invention is that the lines of attachment of the upper margins 38 of the inner container body to the outer container body are spaced above the lines of attachment of the fastener means portions to the container and hence they will be located in the spiral formation. When chambers 40 and 42 are inflated, pressurized air will be forced up into the spiral wrap as shown in FIG. 4 at 76 and 78, adding to the tightness and security of the seal.

Figure 6:
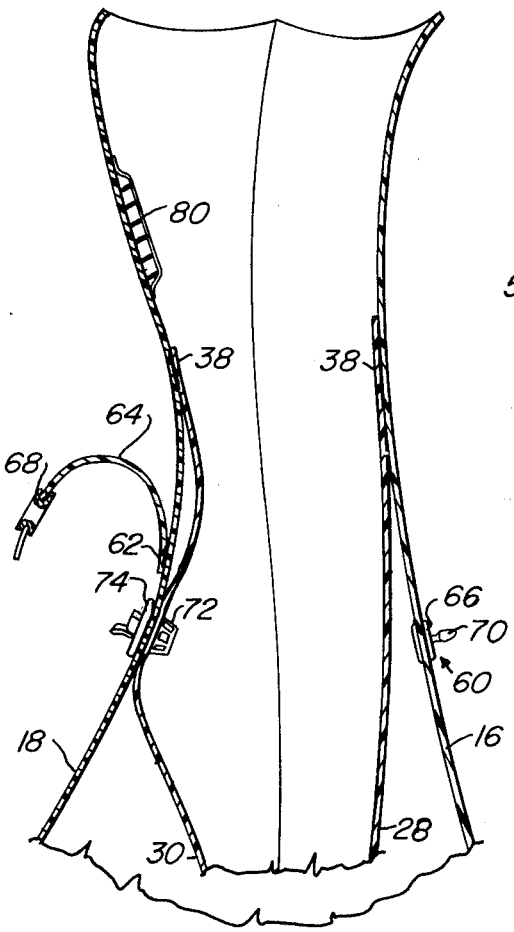
FIG. 6 is a fragmentary sectional view of the upper portion of the container showing a modification.
Figure 8:
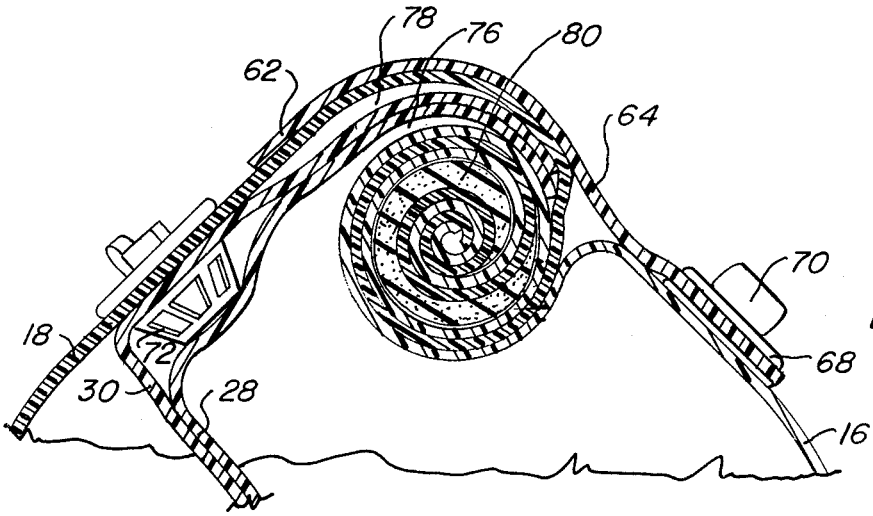
FIG. 8 is a view similar to FIG. 4 showing the modification of FIG. 6.

Additional tightening of the seal may be obtained by providing at least one long narrow resiliently yieldable filler strip such as strip 80, shown in FIGS. 6 to 8, which extends laterally across and is secured to the upper portion 54 of at least one wall of the outer container body 12 well above the line of attachment of the fastener means 58, 60. It is wrapped into the spiral formation as shown in FIG. 8 and its resilience and bulk increase the pressure and sealing effect. The strip may be mounted on the exterior surface but it is preferably mounted on the interior surface as shown, for protection from damage. A similar strip may be mounted on the opposite wall to engage the first strip and further increase the sealing effect. The strips comprise lengths of soft resilient plastic foam, such as vinyl foam, and are covered with lengths of flexible protective material which may be provided with a tacky surface for contact with the opposing strips to further increase the sealing effect.

Figure 9:
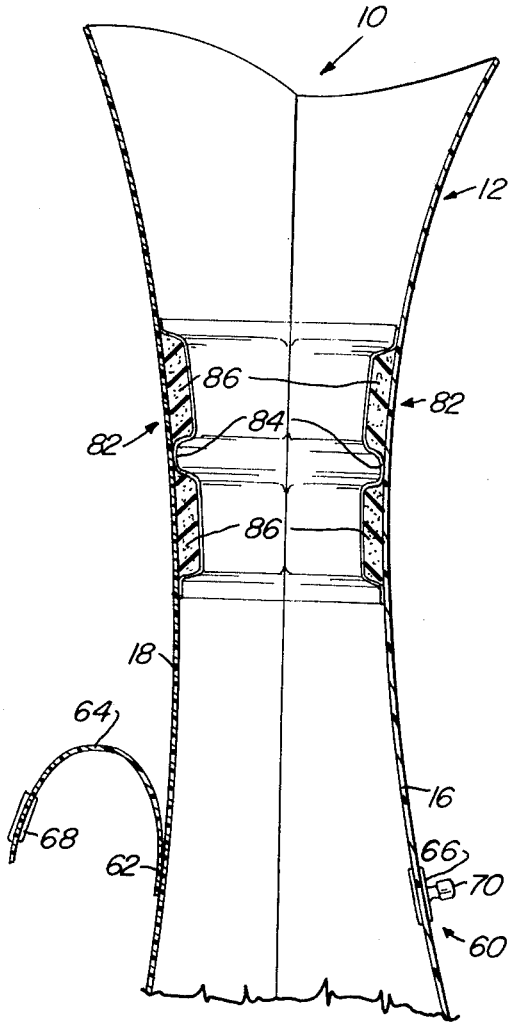
FIG. 9 is a view similar to FIG. 6 showing a further modification.
Figure 10:
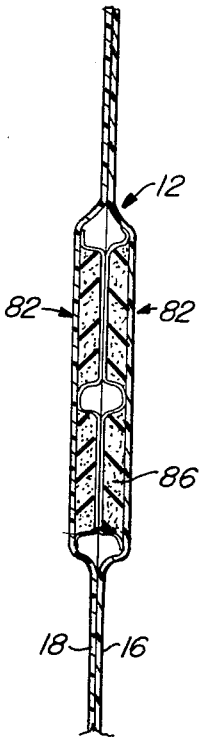
FIG. 10 is a view similar to FIG. 9 showing the filler strips in contact.
Figure 11:
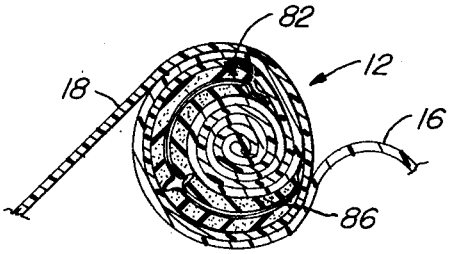
FIG. 11 is a view similar to FIGS. 4 and 8 showing the modification of FIG. 9.

A modified type of filler strip is illustrated in FIGS. 9, 10, and 11. Strip 82 is of the same material and nature as the strip previously described but is considerably broader and is divided by one or more longitudinally extending recesses 84 into a plurality of narrow substrips 86. The two main strips 82 are brought into contact with each other and then wrapped up into the spiral formation shown in FIG. 11. The strips are subdivided so that they flex more readily into the spiral. This type is particularly suitable for use with a container which does not have an inner container body and thus does not have assistance from the air in the inflation chambers. However it is suitable for use in the chamber type container and strip 80 may be used in the single container.

What is claimed is:

1. A container for fragile articles, comprising:

an outer container body of flexible material composed only of first and second, forward and rear, walls constituting the outer walls of the container, the walls being sealingly connected directly to each other at the bottom and at the side margins of the container and open at the upper end of the container;

and an inner container body of flexible material composed only of first and second, forward and rear, walls sealingly connected directly to each other at the bottom and at the side margins and open at the upper margins to provide a storage compartment for reception of articles to be protected;

the side margins of the inner container body being sealingly connected directly to the side margins of the outer container body;

the upper margins of the forward and rear walls of the inner container body being sealingly connected to the upper portions of the respective forward and rear walls of the outer container body below the top of the outer container body;

and the bottom margin of the inner container body being sealingly connected to at least one of the outer walls of the container;

and fastener means on the upper portions of the outer walls of the container to hold the free ends in adjacency;

the inner and outer container bodies cooperating to define a first inflation chamber between the inner container body and a first wall of the outer container body and a second inflation chamber between the inner container body and the second wall of the outer container body, with the inner container body serving as a partition to prevent flow of air between the two chambers;

and a valved air flow port in each outer wall for independent inflation of each of the chambers;

the chambers being inflatable to form air cushions pressing toward each other to force the major portion of the air out of the storage compartment and cause its walls to conform to and grip a stored article.

2. A container as claimed in claim 1; in which the bottom of the storage compartment within the inner container body is connected to the outer container body above the bottom of the outer container body.

3. A container as claimed in claim 1; in which the bottom margin of the inner container body is sealingly connected to one outer wall of the container at a substantial distance above the bottom of the container.

4. A container as claimed in claim 1; in which the upper portions of the walls of the outer container body, above the upper margins of the forward and rear walls of the inner container body, are formed to engage each other in facewise sealing relation and the fastener means serves to maintain them in such relation.

5. A container as claimed in claim 4; in which a valve air flow port is provided which passes through an outer wall of the container and through the adjacent wall of the inner container body to the interior of the storage compartment to release trapped air from the compartment in response to expansion of the inflation chambers.

6. A container as claimed in claim 4; in which the upper portions of the forward and rear walls of the outer container body are adapted to be wrapped up into a spiral formation about an axis extending laterally of the container body to press the walls in sealing relation;

and the fastener means comprises a first portion extending laterally across and secured to one exterior face of the upper portion of the outer container body well below its upper end and a second portion extending laterally across and secured to the other exterior face of the upper portion of the outer container body well below its upper end;

at least one fastener means portion being in the form of a vertically extensive elongate lateral strip secured only along its lower marginal edge to the container body with its upper portion overlying the spiral formation;

and cooperating connector means are provided on the first and second fastener means portions to lock them together and maintain the spiral formation in wrapped condition.

7. A container as claimed in claim 6; in which the lines of attachment of the upper margins of the inner container body to the outer container body are spaced above the lines of attachment of the fastener means portions to the outer container body to allow pressurized air from the inflation chambers to enter the spiral formation and increase the sealing effect.

8. A container as claimed in claim 6; in which at least one long narrow resiliently yieldable filler strip extends laterally across and is secured to the upper portion of at least one wall of the outer container body above the line of attachment of the fastener means to be wrapped into the spiral formation and increase its bulk and sealing effect.

9. An inflatable article of luggage for pneumatically cushioning and holding articles placed therein, said article comprising:

a rectangular outer envelope having an opening formed therethrough at its top;

an inner liner shaped to approximate said outer envelope;

said inner liner being air tightly fastened to the interior of said outer envelope at said opening;

said liner and said envelope thereby defining an enclosed air space therebetween; an extension sleeve integral with said envelope at said opening;

said sleeve defining therewithin a passage communicating with said inner liner;

said sleeve being formed from a flexible material whereby said sleeve may be folded to close off said passage;

an air valve, communicating through said envelope to said air space, whereby said article may be inflated by admitting air through said valve; and a closure adapted to selectively retain said sleeve when folded to close off said passage.

10. The apparatus as recited in claim 9 wherein said closure comprises a flap having two ends;

the first of said ends attached to said article proximate said sleeve;

the second of said ends selectively attachable to said article whereby said flap overlaps said sleeve when said sleeve is folded.

11. In an inflatable gripping case, flexible sides enclosing a compartment, at least one flexible side having double walls to form an inflatable side, the wall adjacent said compartment being pliable so as to conform to the contour of an article in said compartment, closeable intake means for inflating said double-walled side, a portion of said compartment being open to permit the insertion of articles to be stored therein, a sleeve on said open portion of said compartment for the insertion of articles to be stored in the compartment, said sleeve being flexible and foldable;

means for securing and covering the sleeve in folded position so as to prevent water entering into said compartment, the entire periphery of said sides and said sleeve, being imperviously integrated.

12. The inflatable gripping case specified in claim 11, wherein each of opposite sides of said case being double walled and inflatable, and at least the inner wall of said double-wall sides being stretchable to firmly embrace the article stored in said compartment upon inflation of said double walls.

* * * * *